US007415806B2

(12) United States Patent
Davidson

(10) Patent No.: US 7,415,806 B2
(45) Date of Patent: Aug. 26, 2008

(54) BALLISTIC ABATEMENT BARRIER METHOD AND SYSTEM

(76) Inventor: Thomas D. Davidson, 5606 NW. 117 Ave., Coral Springs, FL (US) 33076

( * ) Notice: Subject to any disclaimer, the term of this patent is extended or adjusted under 35 U.S.C. 154(b) by 415 days.

(21) Appl. No.: 10/886,975

(22) Filed: Jul. 8, 2004

(65) Prior Publication Data

US 2007/0193221 A1 Aug. 23, 2007

(51) Int. Cl.
*E04B 2/00* (2006.01)

(52) U.S. Cl. ..... 52/426; 52/267; 52/268; 52/269; 52/450; 52/451; 52/452; 52/483.1; 52/202; 52/203; 52/783.11; 52/783.12; 89/36.11; 89/36.02; 89/36.04; 109/49.5; 109/78; 109/79; 109/80; 109/81; 109/82; 109/83; 109/84; 109/85

(58) Field of Classification Search ..... 52/232, 52/267–269, 450–452, 455, 483.1, 202, 203, 52/783.11, 783.12, 783.14, 783.17; 428/73, 428/116, 118, 911, 920, 921; 89/36.11, 36.02, 89/36.04; 244/129.5, 121, 119, 118.5; 109/78–85, 109/49.5
See application file for complete search history.

(56) References Cited

U.S. PATENT DOCUMENTS

| | | | | | |
|---|---|---|---|---|---|
| 140,526 | A | * | 7/1873 | Munson, Jr. | 52/783.11 |
| 787,065 | A | * | 4/1905 | White | 114/12 |
| 2,110,322 | A | | 3/1938 | Calzavara | |
| 2,279,110 | A | | 4/1942 | Collins | |
| 2,399,184 | A | * | 4/1946 | Heckert | 109/82 |
| 2,746,892 | A | * | 5/1956 | Elfving | 428/186 |
| 3,382,821 | A | | 5/1968 | Dundr | |
| 4,061,815 | A | | 12/1977 | Poole, Jr. | |
| 4,078,350 | A | * | 3/1978 | Ting | 52/475.1 |
| 4,201,385 | A | * | 5/1980 | Szabados | 273/410 |
| 4,323,000 | A | | 4/1982 | Dennis et al. | |
| 4,404,889 | A | * | 9/1983 | Miguel | 89/36.02 |
| 4,455,801 | A | * | 6/1984 | Merritt | 52/309.9 |
| 4,509,301 | A | * | 4/1985 | Head | 52/79.8 |
| 4,529,640 | A | | 7/1985 | Brown et al. | |
| 4,566,237 | A | * | 1/1986 | Turner | 52/269 |
| 4,989,493 | A | * | 2/1991 | Blommer et al. | 89/36.02 |
| 5,149,910 | A | | 9/1992 | McKee | |
| 5,167,352 | A | | 12/1992 | Robbins | |
| 5,200,256 | A | | 4/1993 | Dunbar | |
| 5,251,414 | A | | 10/1993 | Duke | |
| 5,390,466 | A | | 2/1995 | Johnson et al. | |
| 5,435,226 | A | * | 7/1995 | McQuilkin | 89/36.02 |
| 5,459,972 | A | * | 10/1995 | Eckel | 52/456 |

(Continued)

*Primary Examiner*—Jeanette Chapman
*Assistant Examiner*—Daniel Kenny
(74) *Attorney, Agent, or Firm*—Akerman Senterfitt; Pablo Meles

(57) ABSTRACT

A modular ballistic abatement barrier system (10) includes a first corrugated panel (12) having at least one aperture (13), a second corrugated panel (16) having at least one aperture (17), and a ballistic cloth (14) placed between the first corrugated panel and the second corrugated panel. The ballistic cloth can also include at least one aperture (15). The first corrugated panel and the second corrugated panel are coupled using at least one among a mechanical bond and a chemical bond. For example, the ballistic cloth can be laminated between the first corrugated panel and the second corrugated panel to form a multi-layered panel. Alternatively, the first corrugated panel, the ballistic cloth, and the second corrugated panel can be coupled together using a fastener that compresses the ballistic cloth between the first corrugated panel and the second corrugated panel.

11 Claims, 11 Drawing Sheets

U.S. PATENT DOCUMENTS 5,531,500 A 7/1996 Podvin
5,635,288 A * 6/1997 Park ..... 428/105
5,640,824 A 6/1997 Johnson et al.
5,645,184 A 7/1997 Rowse et al.
5,723,201 A 3/1998 Czetto, Jr.
5,736,474 A 4/1998 Thomas
5,855,099 A * 1/1999 Hoffman ..... 52/202
5,935,678 A 8/1999 Park
5,964,435 A * 10/1999 Peltier ..... 248/166
6,151,849 A * 11/2000 Twigg et al. ..... 52/208
D437,943 S * 2/2001 Velidedeoglu et al. ..... D25/48
6,205,728 B1 3/2001 Sutelan
6,209,263 B1 * 4/2001 Poirier ..... 49/61
6,357,332 B1 3/2002 Vecchio
6,568,310 B2 * 5/2003 Morgan ..... 89/36.02
6,612,217 B1 * 9/2003 Shockey et al. ..... 89/36.11
6,669,144 B2 * 12/2003 Artsiely ..... 244/129.5
6,703,104 B1 * 3/2004 Neal ..... 428/118
6,711,980 B2 * 3/2004 Kropf ..... 89/36.09
6,830,217 B2 * 12/2004 Movsesian et al. ..... 244/129.5
6,986,221 B2 * 1/2006 Mullis ..... 42/74
7,032,863 B1 * 4/2006 Piorkowski et al. ..... 244/129.4

* cited by examiner

BALLISTIC ABATEMENT BARRIER METHOD AND SYSTEM

FIELD OF THE INVENTION

This invention relates generally to shielding devices, and more particularly to a method and arrangement for providing ballistic abatement.

BACKGROUND OF THE INVENTION

Numerous shielding and ballistic abatement barriers exist that fail to provide a low-cost, modular and transportable system that can be easily assembled or deployed, disassembled, and reassembled or redeployed once again. If such a barrier exists, it likely provides poor ballistic abatement. More likely than not, any existing abatement system is overly complicated to assemble or disassemble and costly. Many existing ballistic abatement systems are fixed or a part of permanent construction or structure that is not meant to be disassembled. Many others are costly using expensive and heavy materials such as bulletproof glass or glass along with other laminates that provide some level of ballistic abatement.

Hurricane shutters typically made of aluminum are lightweight, but by themselves fail to provide sufficient ballistic abatement during periods of high risk when superior protection from bullets, shrapnel and other debris associated with explosions might be required. In a military scenario, although transportable, hurricane shutters would not provide adequate protection from ballistic projections. In the field, soldiers need to deploy and maneuver and redeploy rapidly in the field of combat. In some instances, soldiers spend hours and even days creating barriers from local fill only to leave the fruit of their efforts in place to move to another hostile area requiring the same type of barrier to be built in a similar time consuming manner.

SUMMARY OF THE INVENTION

Embodiments in accordance with the present invention utilize a ballistic cloth between corrugated panels to form several ballistic abatement barrier methods and systems. Some methods and systems are designed to reinforce an existing structure and other methods and systems can form a structure from ballistic abatement barrier panels formed in accordance with an embodiment of the present invention. In a first embodiment of the present invention, a modular ballistic abatement barrier system including a first corrugated panel having at least one aperture, a second corrugated panel having at least one aperture, and a ballistic cloth placed between the first corrugated panel and the second corrugated panel. The first corrugated panel and the second corrugated panel are coupled using at least one among a mechanical bond and a chemical bond. For example, the ballistic cloth can be laminated between the first corrugated panel and the second corrugated panel to form a multi-layered panel. Alternatively, the first corrugated panel, the ballistic cloth, and the second corrugated panel can be coupled together using a fastener that compresses the ballistic cloth between the first corrugated panel and the second corrugated panel. The first and second corrugated panels can be made from metal such as aluminum or steel, but can also be made of other materials. The ballistic cloth can be made from aramid fibers, but can also be made of other materials exhibiting ballistic abatement characteristics. The modular ballistic abatement barrier system can further include a shooter's window.

In a second embodiment of the present invention, a modular ballistic abatement barrier system can include, comprising a first corrugated metal panel having at least one aperture, a second corrugated metal panel having at least one aperture, and a ballistic cloth placed between the first corrugated metal panel and the second corrugated metal panel. The first and second corrugated metal panels can be coupled using at least one among a mechanical bond and a chemical bond.

In a third embodiment of the present invention, a modular ballistic abatement barrier system includes an exterior wall, an interior wall, and a faster. The exterior wall can be formed from a first corrugated panel having at least one aperture therein, a second corrugated panel having at least one aperture therein; and a ballistic cloth placed between the first corrugated panel and the second corrugated panel. The interior wall can be formed from a third corrugated panel having at least one aperture therein, a fourth corrugated panel having at least one aperture therein, and a ballistic cloth placed between the third corrugated panel and the fourth corrugated panel. The first corrugated panel and the second corrugated panel are coupled together and the third corrugated panel and the fourth corrugated panel are coupled together respectively using at least one among a mechanical bond and a chemical bond. A fastener is used through respective apertures of the first, second, third and fourth corrugated panels. The modular ballistic abatement barrier system can further include filler such as rocks, pebbles, dirt, concrete, sand, or gravel between the exterior wall and the interior wall. The ballistic abatement barrier system can be substantially triangular in shape and arranged and constructed to enable selective unfastening of fasteners while generally allowing filler to release from a lower area of the system first if desired. Again, the corrugated panels can be made from metal such as aluminum or steel, but other materials can be used. The ballistic cloth can also be made from aramid fibers, but other materials can also be used. The ballistic cloth can be laminated between the first corrugated panel and the second corrugated panel and further laminated between the third corrugated panel and the fourth corrugated panel. The fastener can be any number of fasteners such as a bolt and nut or alternatively a slotted dumbbell having slots that mate with the at least one aperture in the exterior wall and the at least one aperture in the interior wall. The modular ballistic abatement barrier system can further include at least one endcap coupled between the exterior wall and the interior wall which can also include a slot for accommodating a portion of the slotted dumbbell.

In a fourth embodiment of the present invention, a method of forming a modular ballistic abatement barrier includes the steps of providing a first corrugated metal panel having at least one aperture therein, providing a second corrugated metal panel having at least one aperture therein; placing a ballistic cloth between the first corrugated metal panel and the second corrugated metal panel, and selectively interlocking the first corrugated metal panel and the second corrugated metal panel using a fastener through respective apertures of the first and second corrugated metal panels.

In a fifth embodiment of the present invention, a method of reinforcing a vulnerable area in a structure using a ballistic abatement barrier include the steps of providing a first corrugated metal panel having at least one aperture therein, providing a second corrugated metal panel having at least one aperture therein, placing a ballistic cloth between the first corrugated metal panel and the second corrugated metal panel forming the ballistic abatement barrier, and fastening the ballistic abatement barrier to the structure to cover at least a portion of the vulnerable area using a fastener through respective apertures of the first and second corrugated metal panels.

DETAILED DESCRIPTION OF THE DRAWINGS

Figure 1:
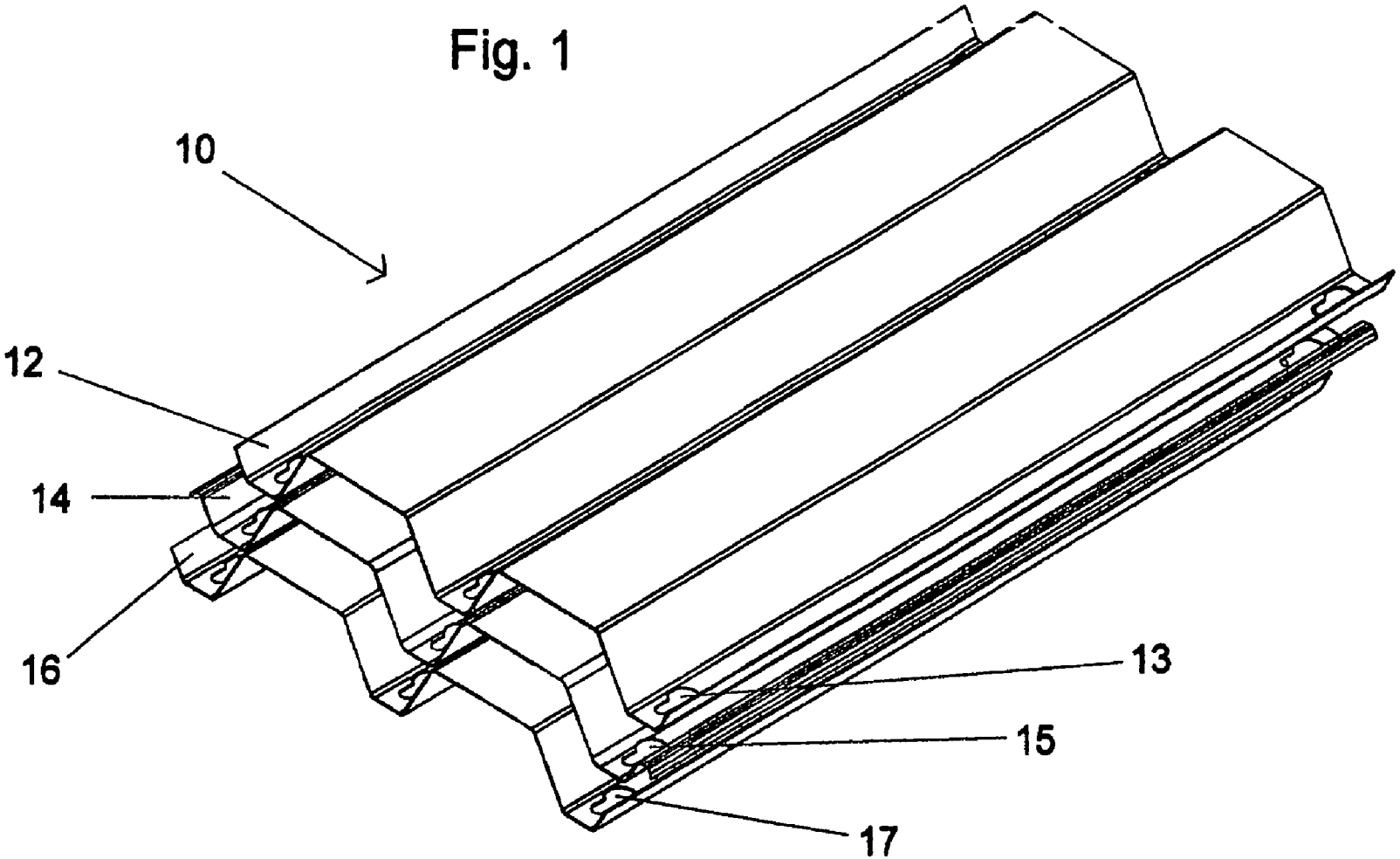
FIG. 1 is an exploded perspective view of a barrier in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Referring to FIG. 1, In one embodiment in the form of a modular ballistic abatement barrier system 10 can include a first corrugated panel 12 having at least one aperture 13, a second corrugated panel 16 having at least one aperture 17, and a ballistic cloth 14 placed between the first corrugated panel 12 and the second corrugated panel 16. The ballistic cloth can also include at least one aperture 15. The first corrugated panel and the second corrugated panel are coupled using at least one among a mechanical bond and a chemical bond. For example, the ballistic cloth can be laminated between the first corrugated panel and the second corrugated panel to form a multi-layered panel. The lamination process can involve coating opposing sides of the ballistic cloth 14 with epoxy resin. Alternatively, the first corrugated panel 12, the ballistic cloth 14, and the second corrugated panel 16 can be coupled together using a fastener that compresses the ballistic cloth between the first corrugated panel and the second corrugated panel. Such fasteners can also include rivets, nuts and bolts and the like. Unfortunately, such fasteners can become projectiles themselves when the fasteners themselves get hit by ballistic debris or projectiles. The first and second corrugated panels can be made from metal such as aluminum or steel, but can also be made of other materials. The ballistic cloth can be made from aramid fibers, but can also be made of other materials exhibiting ballistic abatement characteristics. The grade, dimensions and thickness of the materials used to form the system 10 can vary depending on the ballistic abatement needs. A typical width for a panel can be between 12 to 24 inches, although other widths are certainly contemplated. The depth of corrugation can typically be between 1 and 4 inches. The aluminum can typically have a thickness between 0.030 and 0.080 inches whereas if steel were used, the steel gauge can typically range from 18 through 30.

Figure 2:
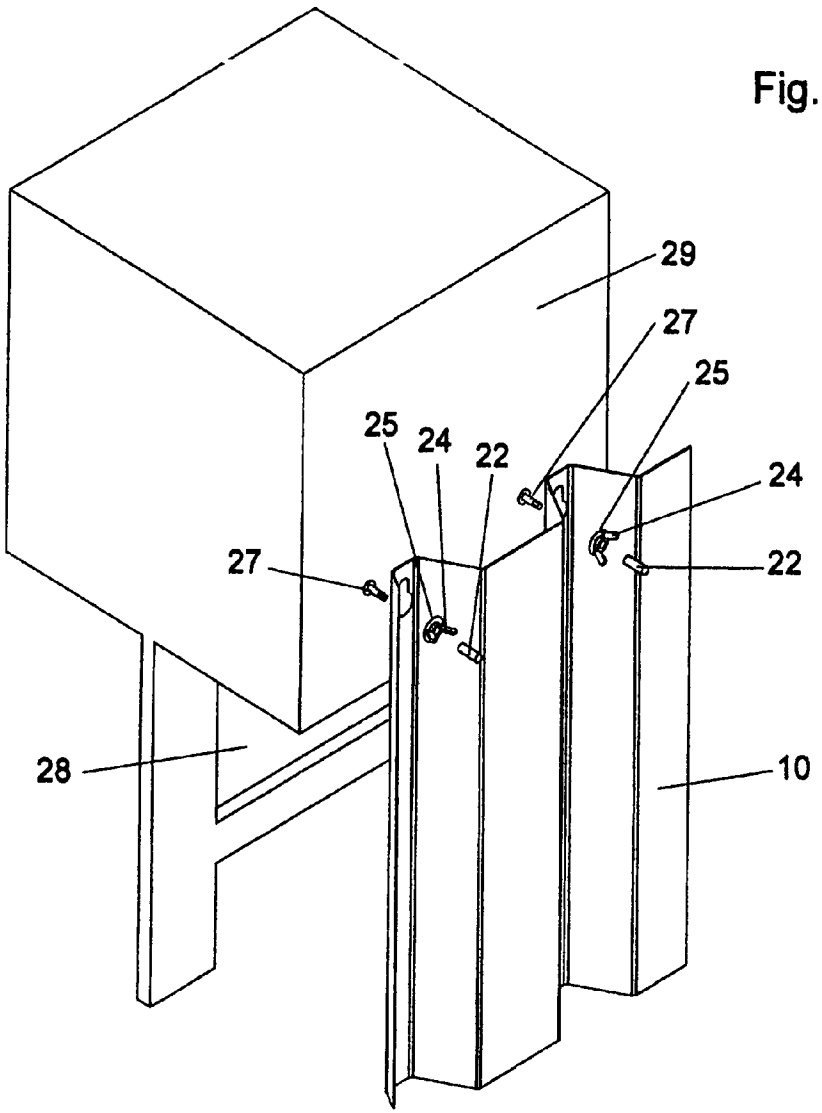
FIG. 2 is a perspective view of the barrier of FIG. 1 as applied to a window, opening or vulnerable area of a wall or building in accordance with an embodiment of the present invention.
Figure 3:
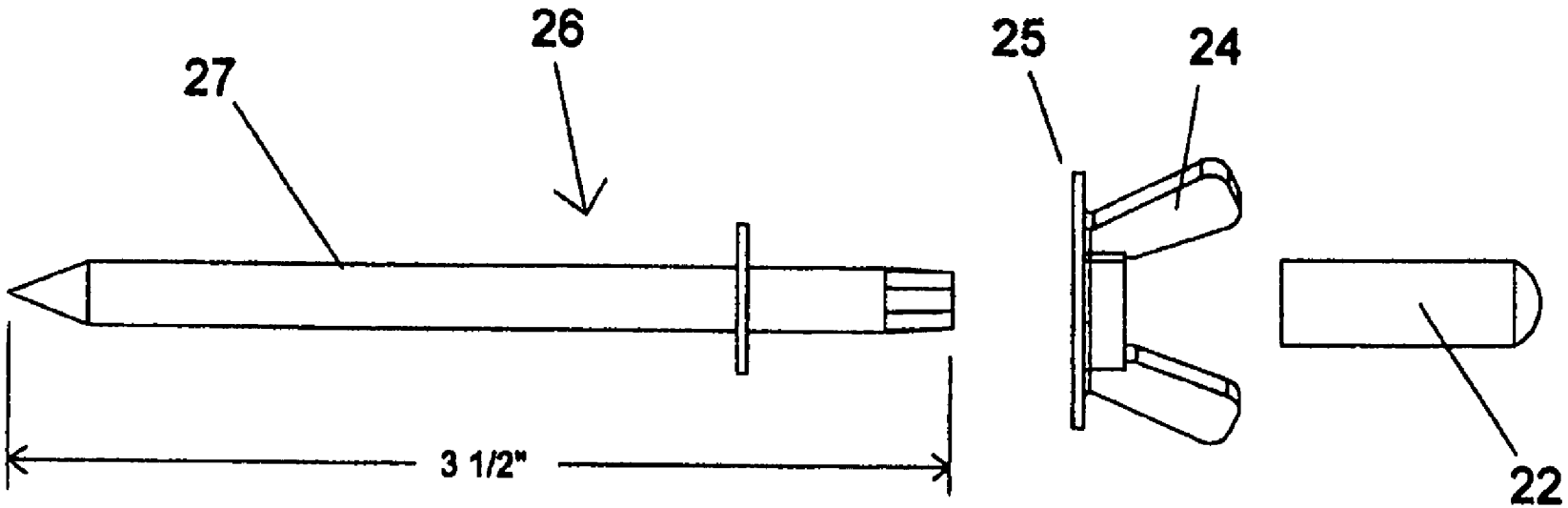
FIG. 3 illustrates a fastener that can be used with the barrier of FIG. 1 in accordance with an embodiment of the present invention.

Referring to FIG. 2, a perspective view of the modular ballistic abatement, barrier system 10 is shown as applied to a structure 29 having vulnerable areas such as a window area 28. Once the corrugated panels 12 and 16 come in a laminated form as shown to form the modular ballistic abatement barrier system 10, they can simply be fastened to the structure 29 using any number of fasteners. In this instance, a Studcon fastener can be used. The Studcon can include a stud 26 that is usually embedded in the structure or wall 29, an embedded portion 27 as shown in FIG. 3 as well as a washered wingnut 24 having a washer portion 25 and an protective cap 22. The protective cap 22 is typically used for protection of the thread on the stud head. A typical size Studcon for use with the system 10 can be a ¼ inch diameter Studcon with a 14-20 threaded stud head.

Figure 4:
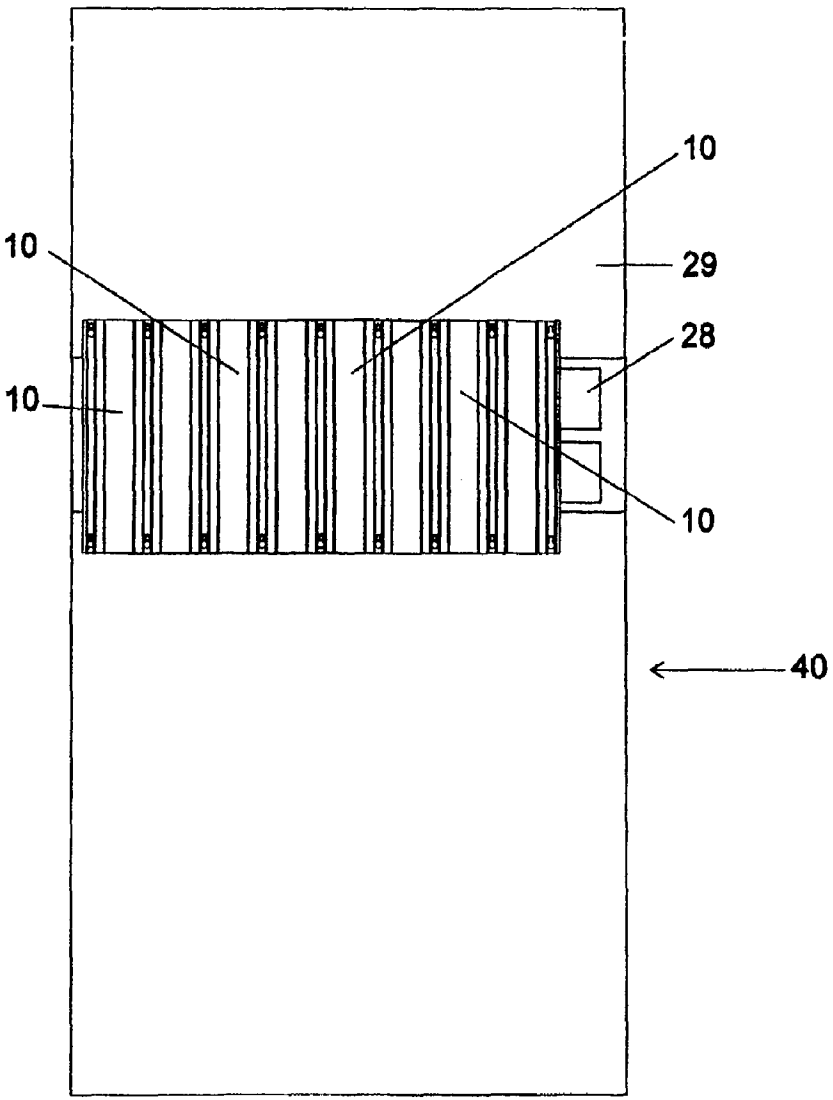
FIG. 4 is a front plan view of several barriers coupled together as applied to a window or several window of a building in accordance with an embodiment of the present invention.

A plurality of modular abatement barrier systems 10 can be coupled together in an interlocking fashion to form a larger system 40 as shown in FIG. 4. Thus, the system 40 can accommodate a wide variety of vulnerable area sizes on a structure 29. A building with many windows 28 adjacent to each other can be protected using the system 40 in this manner.

Figure 5:
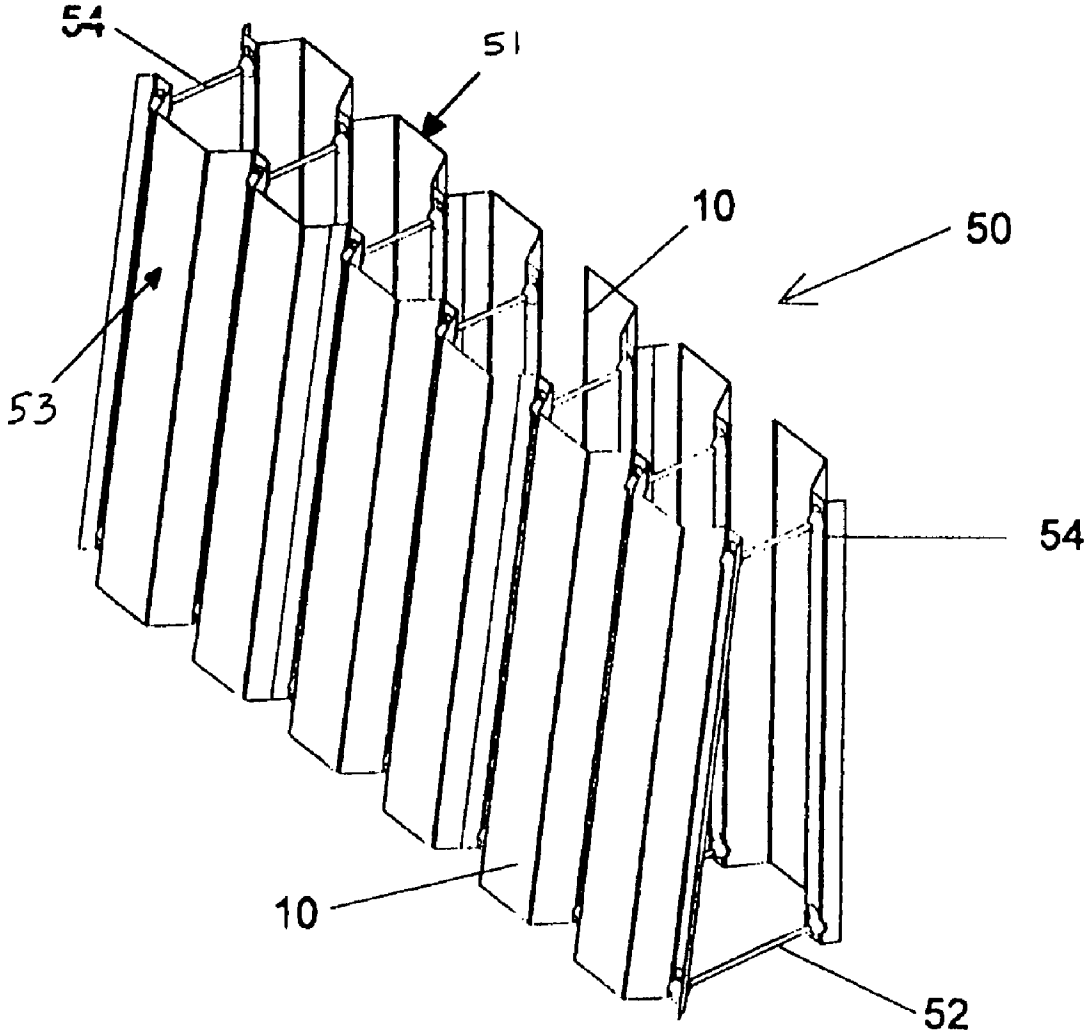
FIG. 5 is a perspective view of a barrier wall constructed using the barrier of FIG. 1 in accordance with an embodiment of the present invention.
Figure 6:
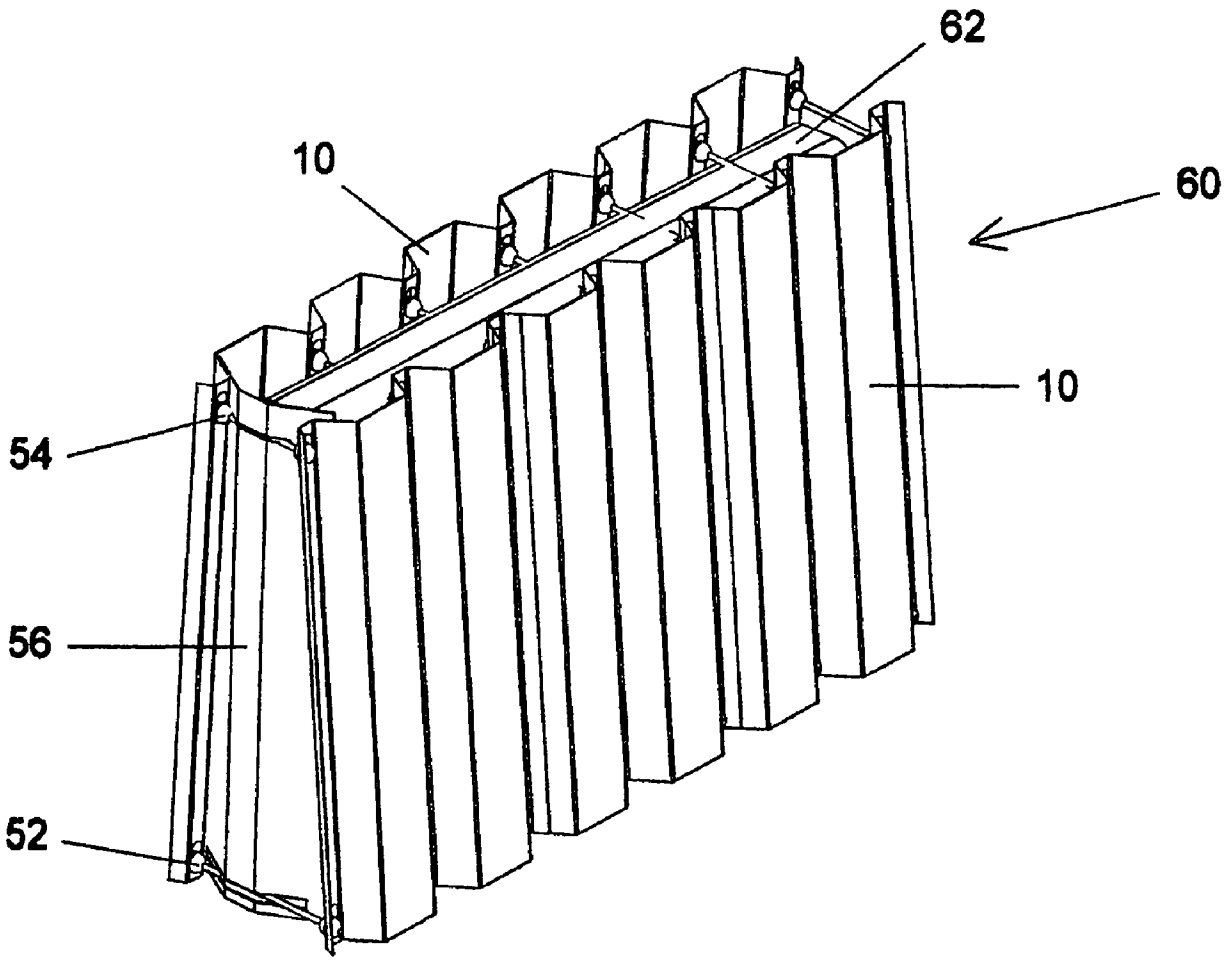
FIG. 6 is a perspective view of a barrier wall constructed using the barrier of FIG. 1 as well as fill in accordance with an embodiment of the present invention.

Referring to FIG. 5, a modular ballistic abatement barrier system 50 includes an exterior wall 51, an interior wall 53, and a fastener (52 and/or 54). The exterior wall 51 can be formed from a first corrugated panel having at least one aperture therein, a second corrugated panel having at least one aperture therein, and a ballistic cloth placed between the first corrugated panel and the second corrugated panel such as the system 10 of FIGS. 1 and 2. The interior wall 53 can likewise be formed from a third corrugated panel having at least one aperture therein, a fourth corrugated panel having at least one aperture therein, and a ballistic cloth placed between the third corrugated panel and the fourth corrugated panel such as the system 10. A fastener (52 and/or 54) is used through respective apertures of the first, second, third and fourth corrugated panels. In other words, a fastener is used through holes in the exterior wall 51 and the interior wall 53. Now referring to FIG. 6, a system 60 similar to system 50 can further include filler 62 such as rocks, pebbles, dirt, concrete, sand, or gravel between the exterior wall and the interior wall. The ballistic abatement barrier system 60 (or 50) can be substantially triangular in shape and arranged and constructed to enable selective unfastening of fasteners on either an upper area or lower area of the system while generally allowing filler to release from a lower area of the system first. During a rapid disassembly of the system 60, the fastener 52 in a lower area can be released first to allow all the filler 62 or a substantial portion of the filler to exit the lower area. In this manner, the remaining fasteners 54 in an upper area of the system 60 can then subsequently be easily removed.

Figure 7:
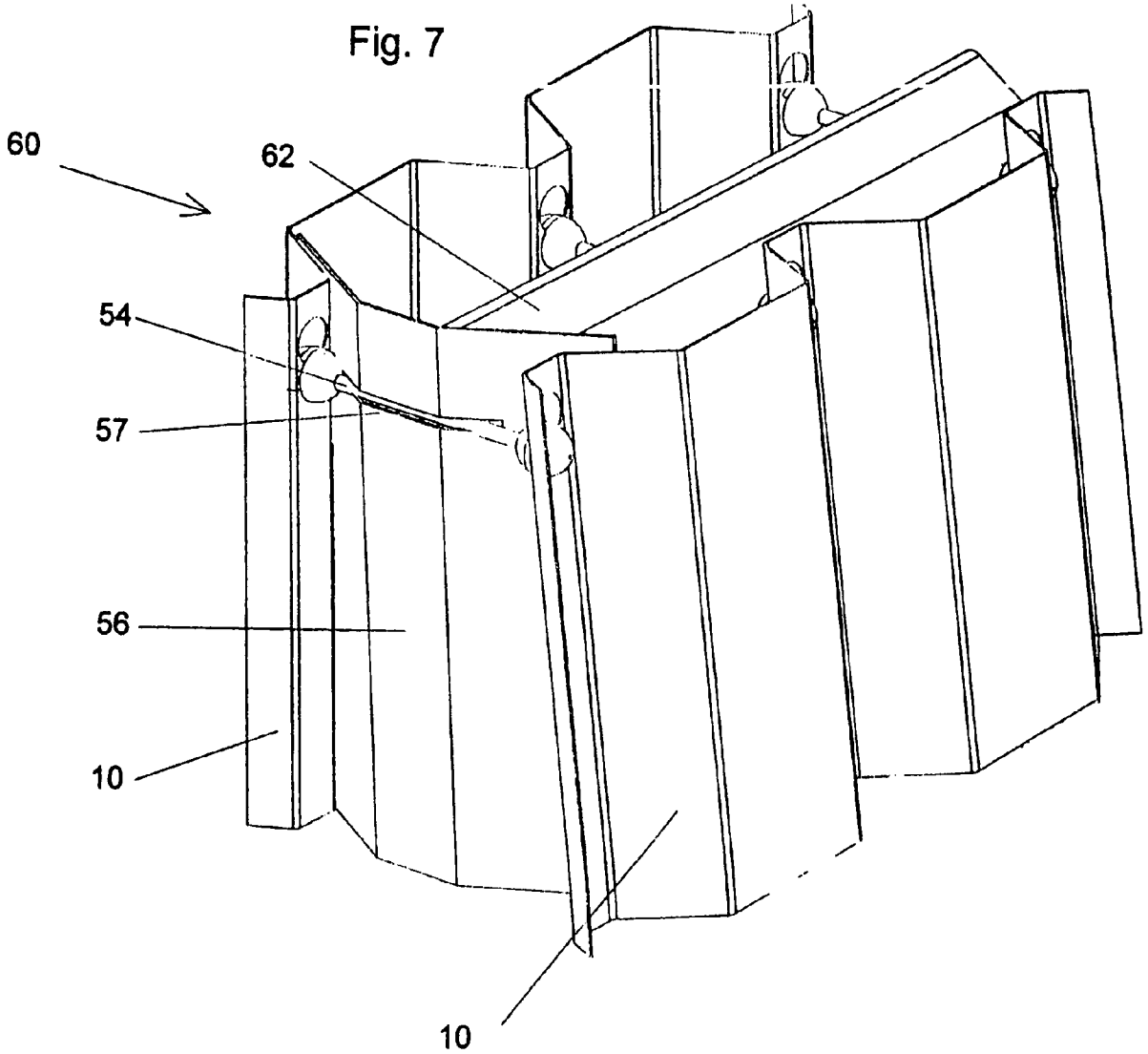
FIG. 7 is a closer perspective of a portion of the barrier wall of FIG. 6.
Figure 8:
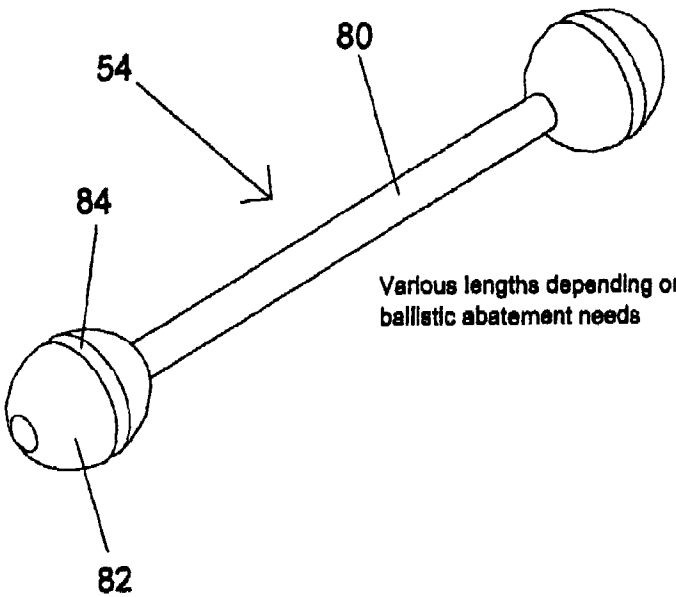
FIG. 8 and FIG. 9 are perspective views of the fasteners used in the barrier wall of FIG. 6.
Figure 9:
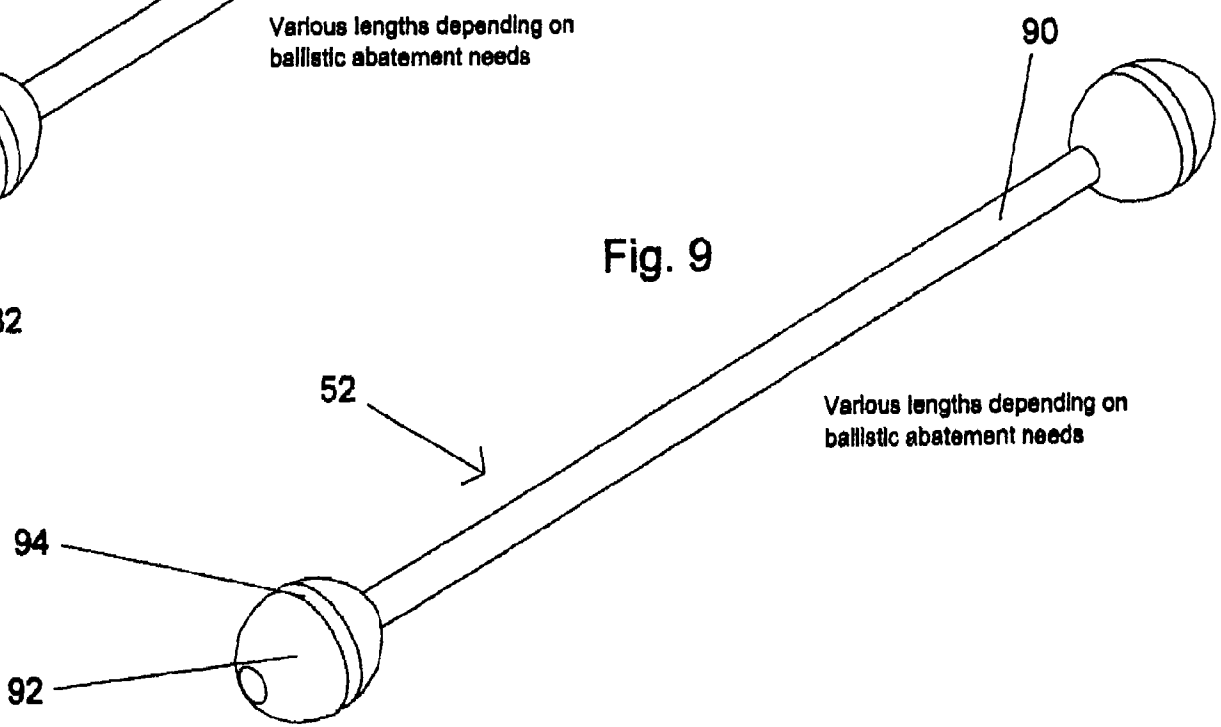

Note again, the corrugated panels can be made from metal such as aluminum or steel, but other materials can be used including plastics and composite materials that are currently too costly to practically manufacture. The ballistic cloth can also be made from aramid fibers such as Kevlar, but other materials can also be used. As previously explained, the ballistic cloth can be laminated between the first corrugated panel and the second corrugated panel and further laminated between the third corrugated panel and the fourth corrugated panel. The fastener can be any number of fasteners such as a bolt and nut or alternatively a slotted dumbbell having slots that mate with the at least one aperture in the exterior wall and the at least one aperture in the interior wall as better illustrated in the closer view of FIG. 7. The slotted dumbbell can be made in a unitary fashion with materials such as Delrin or other plastic material. Advantageously, if the Delrin is exposed to projectiles, the slotted dumbbell itself or any portion thereof will not likely become a projectile that can potentially hurt the inhabitants of the barrier system. When subjected to a projectile, the Delrin will likely decompose rather than cause a chain reaction of projectiles as a rivet might in similar circumstances. The dumbbells can come in various lengths as illustrated in FIGS. 8 and 9. The upper dumbbell 54 as illustrated in FIG. 8 can include a stem 80 and dumbbell portion 82 including a slot 84. The lower dumbbell 52 as illustrated in FIG. 9 can include a stem 90 and a dumbbell portion 92 having a slot 94. The modular ballistic abatement barrier system 60 can further include at least one endcap 56 coupled between the exterior wall and the interior wall which can also include at least one slot 57 for accommodating a portion (the stem) of the slotted dumbbell.

Figure 10:
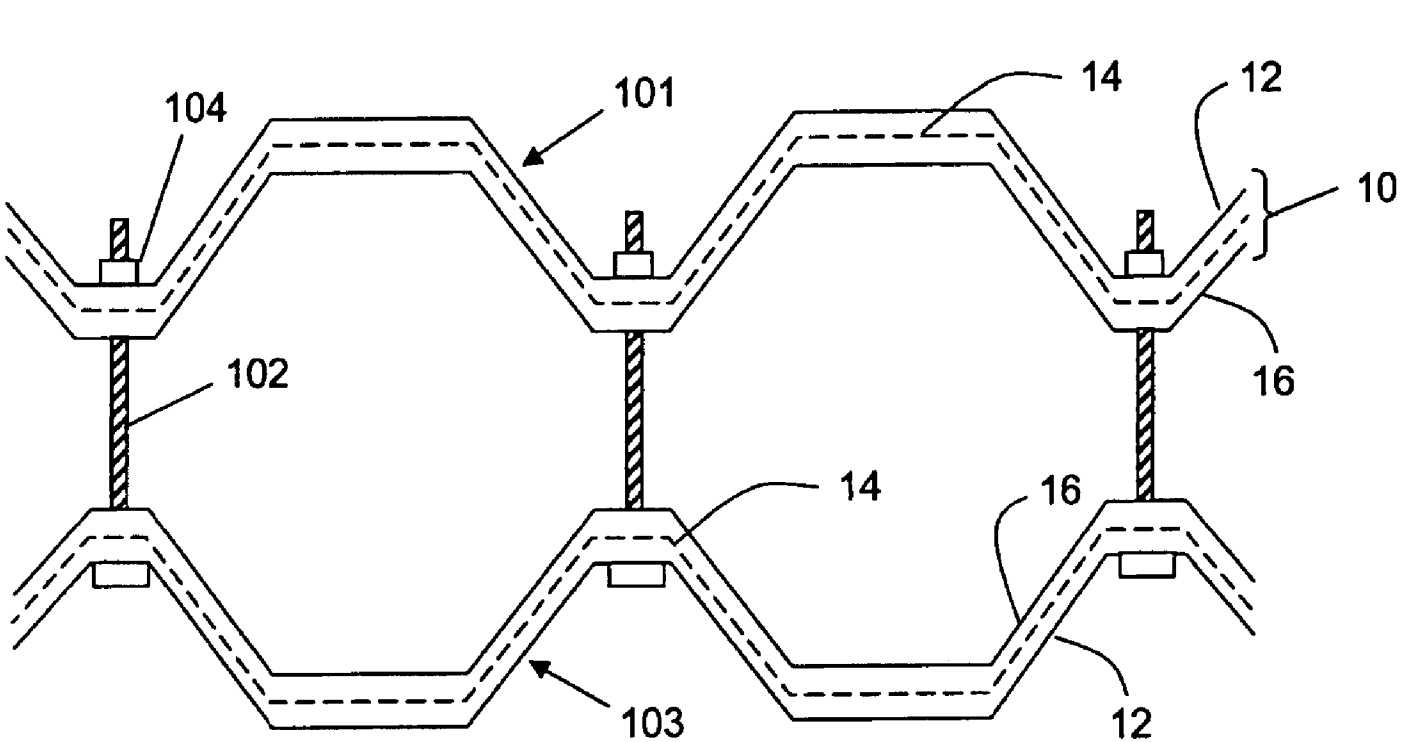
FIG. 10 is a top view of an alternative barrier wall using a different fastener in accordance with an embodiment of the present invention.

Referring to FIG. 10, another modular ballistic abatement barrier system 100 is shown including an exterior wall 101 comprised of the system 10 having the corrugated panel 12, the ballistic cloth 14, and the corrugated panel 16 and interior wall 103 also comprises of the system 10. The exterior wall 101 and the interior wall 103 can be coupled as shown using a nut 104 and bolt 102. Furthermore, the area between the exterior wall 101 and the interior wall 103 can be filled with any type of local fill as discussed in other embodiments.

Figure 11:
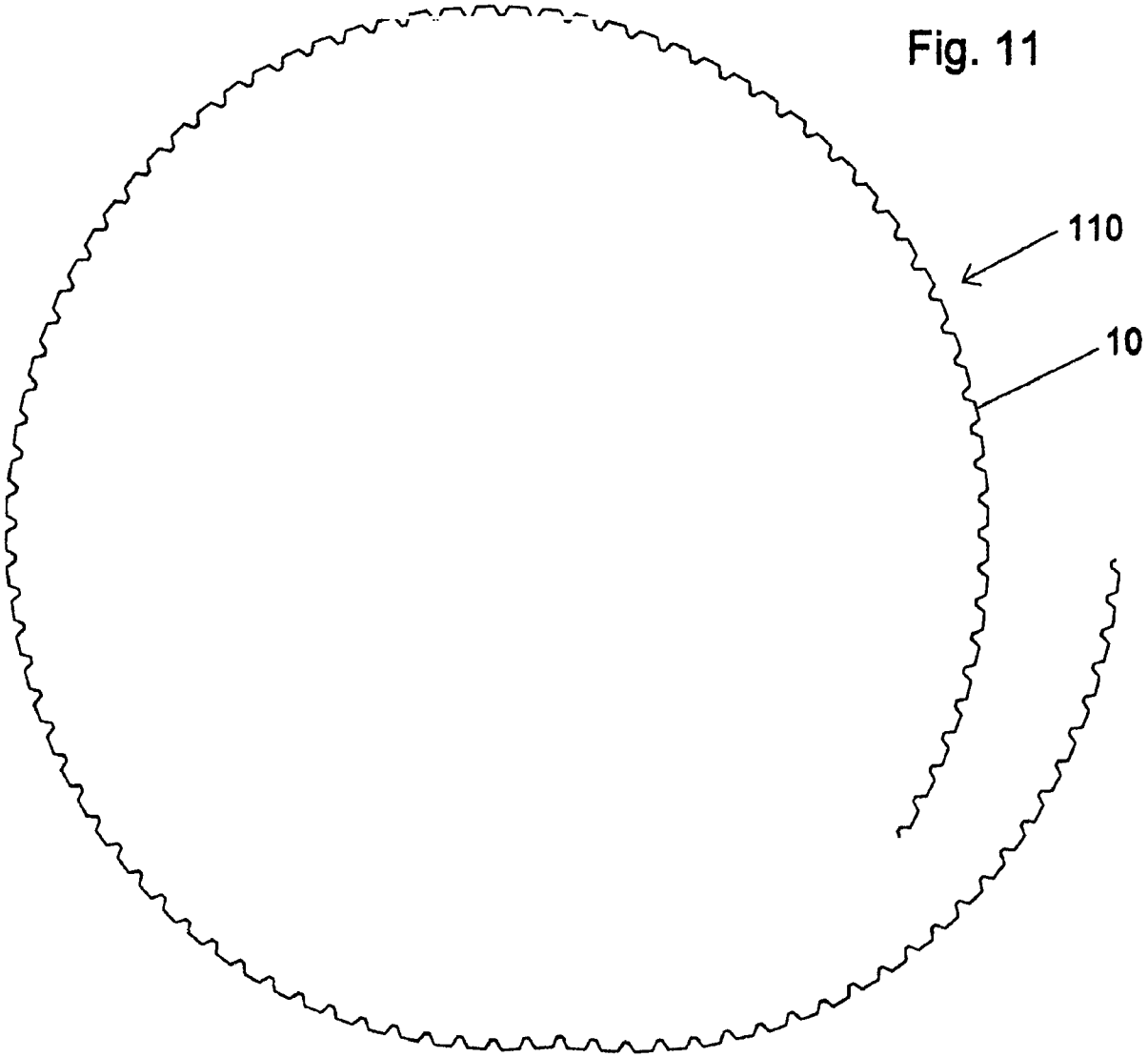
FIG. 11 is top view of a barrier wall assembly using a plurality of barriers as shown in FIG. 1 coupled together in accordance with an embodiment of the present invention.
Figure 12:
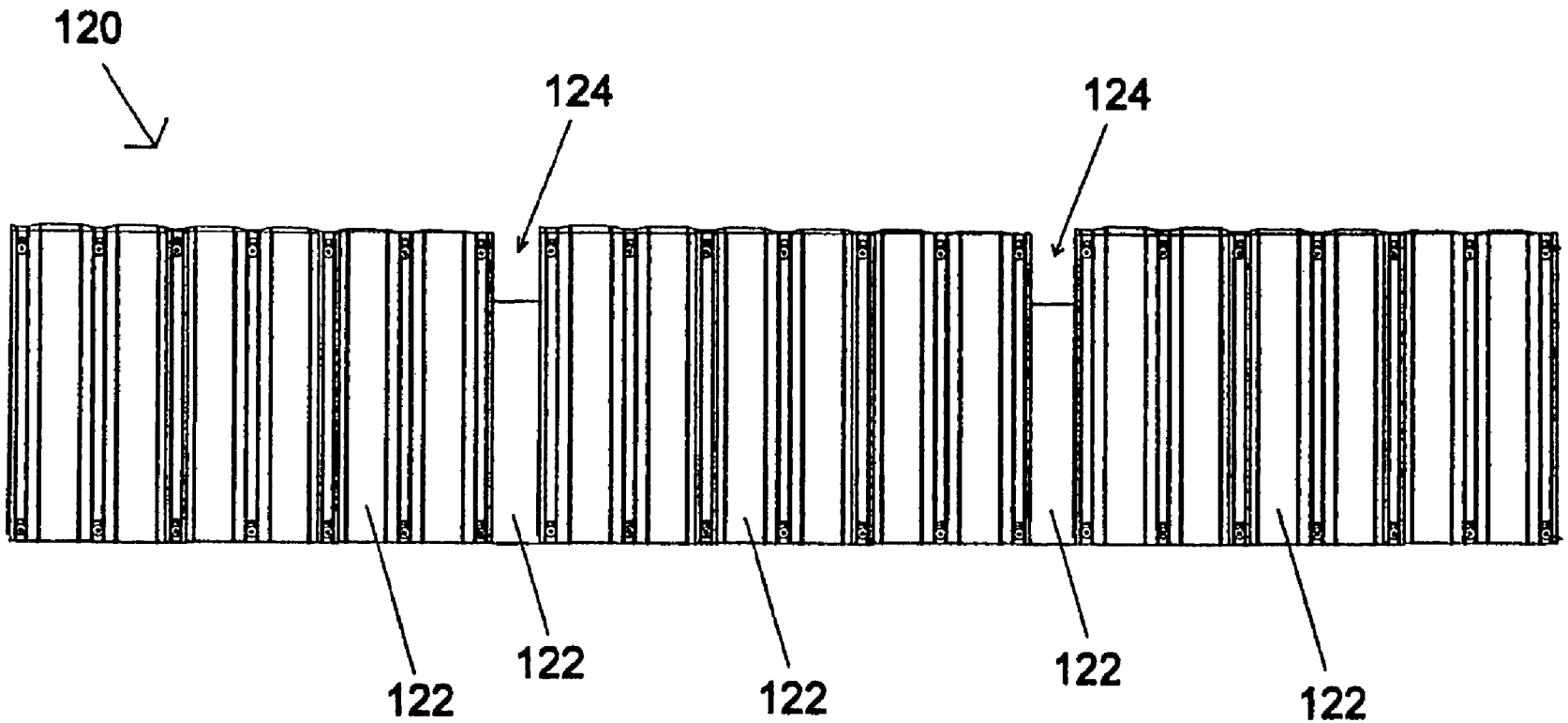
FIG. 12 is a front view of a barrier wall assembly having shooting window in accordance with an embodiment of the present invention.

Note, the panels of system 10 can be quite modular and flexible in the number of configurations that can be made. In a military scenario, barriers of different shapes can be tailored for the uses needed. As shown in FIG. 11, a barrier 110 can be formed in to a corral or other shape as need to protect an encampment of soldiers or for other uses as needed. In another arrangement as shown in FIG. 12, barrier 120 can have a plurality of panels 122 that can include a shooter's window 124.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. A ballistic abatement barrier system, comprising:

a exterior wall formed from a first corrugated panel having at least one aperture therein, a second corrugated panel having at least one aperture therein; and a ballistic cloth placed between the first corrugated panel and the second corrugated panel, wherein the first corrugated panel and the second corrugated panel are coupled using at least one among a mechanical bond and a chemical bond;

an interior wall formed from a third corrugated panel having at least one aperture therein, a fourth corrugated panel having at least one aperture therein, and a ballistic cloth placed between the third corrugated panel and the fourth corrugated panel, wherein the third corrugated panel and the fourth corrugated panel are coupled using at least one among a mechanical bond and a chemical bond; and a fastener through respective apertures of the first, second, third and fourth corrugated panels.

2. The ballistic abatement barrier system of claim 1, wherein the ballistic abatement barrier system further comprises filler between the exterior wall and the interior wall.

3. The ballistic abatement barrier system of claim 2, wherein the filler is selected among the group comprising rocks, pebbles, dirt, concrete, sand, and gravel.

4. The ballistic abatement barrier system of claim 2, wherein the ballistic abatement barrier system is substantially triangular in shape and arranged and constructed to enable selective unfastening of fasteners while generally allowing filler to release from a lower area of the system first if desired.

5. The ballistic abatement barrier system of claim 1, wherein the first, second, third, and fourth corrugated panels are made from metal selected among the group comprising aluminum and steel.

6. The ballistic abatement barrier system of claim 1, wherein the ballistic cloth is made from aramid fibers.

7. The ballistic abatement barrier system of claim 1, wherein the ballistic cloth is laminated between the first corrugated panel and the second corrugated panel and further laminated between the third corrugated panel and the fourth corrugated panel.

8. The ballistic abatement barrier system of claim 1, wherein the fastener comprises a bolt and nut.

9. The ballistic abatement barrier system of claim 1, wherein the fastener comprises a slotted dumbbell having slots that mate with the at least one aperture in the exterior wall and the at least one aperture in the interior wall.

10. The ballistic abatement barrier system of claim 1, wherein the system further comprises at least one endcap coupled between the exterior wall and the interior wall.

11. The ballistic abatement barrier system of claim 9, wherein the system further comprises at least one endcap coupled between the exterior wall and the interior wall, wherein the endcap further includes a slot for accommodating a portion of the slotted dumbbell.

* * * * *